US005274864A

United States Patent [19]

Morgan

[11] Patent Number: 5,274,864

[45] Date of Patent: Jan. 4, 1994

[54] KNOCK DOWN LITTER BOARD

[75] Inventor: Roy L. Morgan, Franktown, Colo.

[73] Assignee: Air Methods, Englewood, Colo.

[21] Appl. No.: 70,016

[22] Filed: Jun. 1, 1993

Related U.S. Application Data

[62] Division of Ser. No. 958,242, Oct. 8, 1992, abandoned.

[51] Int. Cl.[5] ..... A61G 1/013; A61G 1/048

[52] U.S. Cl. ..... 5/627; 5/625; 5/601

[58] Field of Search ..... 5/625–; 128/870, 871; 403/341

[56] References Cited

U.S. PATENT DOCUMENTS

| | | | |
|---|---|---|---|
| 2,201,890 | 5/1940 | Dunn | 5/627 |
| 3,151,343 | 10/1964 | McCormick | 5/628 |
| 3,566,422 | 3/1971 | Klippel | 5/627 |
| 3,648,305 | 3/1972 | Ersek | 5/628 |
| 3,886,606 | 6/1975 | Bradford | 5/627 |
| 3,947,686 | 3/1976 | Cooper et al. | 5/601 |
| 4,252,594 | 2/1981 | Cooper | 378/209 |
| 4,566,445 | 1/1986 | Jelsma et al. | 5/625 |
| 5,054,049 | 10/1991 | Manabe | 378/209 |

FOREIGN PATENT DOCUMENTS

| | | | |
|---|---|---|---|
| 754052 | 8/1956 | United Kingdom | 5/625 |
| 1435223 | 5/1976 | United Kingdom | 378/209 |

*Primary Examiner*—Alexander Grosz

*Attorney, Agent, or Firm*—McCubbrey, Bartels, Meyer & Ward

[57] ABSTRACT

A composite litter board is made from two separate rigid board members that are adapted to be releasably secured to each other by two rigid partial sleeves with C-shaped cross sections that have narrow openings.

2 Claims, 5 Drawing Sheets

KNOCK DOWN LITTER BOARD

This application is a division, of application Ser. No. 07/958,242, filed Oct. 8, 1992 now abandoned.

FIELD OF THE INVENTION

The present invention relates to transportation of injured persons, and more specifically to devices, such as so called litters or stretchers, for transportation of injured persons which may be conveniently carried by two persons.

BACKGROUND OF THE INVENTION

Injuries often result in an injured person becoming physically incapable of self-transport to a medical facility. For example, trauma may result in unconsciousness or dizziness. In addition, self-transport may aggravate the injuries and lead to additional complications. Hence it is often necessary or desirable for medical personnel to transport an injured individual ("patient") to a medical facility while that patient is prone and possible partially or completely immobilized. To this end, so called litters or stretchers are typically employed.

There are several features which are either necessary or desirable for such an apparatus. First, it must be recognized that the patient may need to be transported between difficult to access locations, and that it may therefore be necessary for medical personnel to carry the patient for significant distances. Therefore the apparatus must be capable of supporting a patient for prolonged periods of time. It should also be sufficiently rigid to support the patient in an immobilized condition under circumstances where transport without such immobilization is likely to result in further injury or complications.

The apparatus should therefore also be lightweight, to decrease the overall load to the persons carrying it. In addition, it must be easily portable to the location of the patient prior to use and easily stored for future use. Ideally, it should be easily made available to medical personnel who are not expecting to encounter injured people at a specific location or time.

Further, the patient might be located in water as a result of an accident. Thus, it would be desirable for the transport apparatus to provide some buoyancy in such situations, to assist in the transport of the patient.

In addition, the apparatus should be capable of being easily cleaned. Patients often bleed during transport, and the apparatus should be capable of being cleaned between uses to provide an environment which is not unnecessarily conducive to infection.

Diagnosis of patients often requires the patient be the subject of procedures such as x-ray scanning, CT scanning, and the like. These procedures often require that the patient be placed within or adjacent to a large, fixed apparatus. It would be desirable for the transport apparatus to permit such placement without the necessity of removing the apparatus from the patient, as such removal may lead to greater injury, as mentioned above.

One apparatus long known to the art is the canvas stretcher. A rectangular canvas or cloth piece is attached at parallel sides to elongated rods. Medical personnel may lift the stretcher by means of handles at the ends of the rods. The stretcher may be collapsed by placing the rods together.

The stretcher has only a few of the desired features. It is relatively lightweight and portable. It does not interfere with some diagnostic procedures. Unfortunately, it is also not rigid enough to immobilize patients effectively. This non-rigidity often necessitates additional devices such as splints and boards to provide the necessary stiffness. Such stiffening devices require additional time to attach, and add significantly to the weight of the patient-apparatus combination which must be carried by the medical personnel. In addition, the degree of immobilization needed to prevent compounding of the existing injuries may not be achievable.

Alternatively, a rigid board ("litter board") or other device may be used to transport the patient. Such devices are more rigid than a stretcher, enabling better opportunity for protecting and immobilizing the patient. Such a device, however, is often heavy, hard to clean, cumbersome, and difficult to transport to and from the site of the patient. Moreover, such devices typically utilize metallic components which interfere with x-rays and the like.

Broadly, it is an object of the present invention to provide an improved litter board.

It is a further object of the present invention to provide a portable, lightweight and yet rigid litter board.

It is a yet further object of the present invention to provide a buoyant litter board.

It is a yet further object of the present invention to provide a litter board which may be easily cleaned.

It is a still further object of the present invention to provide a little board which permits diagnostic scanning of a patient without removal from the litter board.

These and other objects of the present invention will be apparent to those skilled in the art from the following detailed description of the invention and the accompanying drawings.

SUMMARY OF THE INVENTION

The present invention comprises a composite litter board. The litter board has a structural non-absorbent non-conductive closed cell foam core board sized to support a human body. In addition, the litter board has a plurality of covering layers superimposed upon the core substantially enclosing the core board. The covering layers include at least one layer of a tear resistant material and at least one layer of composite matrix material. In a preferred embodiment of the present invention, the litter board is devoid of any metallic materials such that the litter board is substantially transparent to x-rays. Also, in a preferred embodiment, the composite matrix material comprises a carbon fiber material and the covering layers further include a smooth non-absorbent coating layer on the exterior of said covering layers substantially covering said litter board.

A second embodiment of the present invention comprises a composite litter board which is separable into segments. It includes a first rigid board segment having a first connection edge and first and second side edges substantially perpendicular to the first connection edge. It further includes a second rigid board segment having a second connection edge shaped to mate with the first connection edge. The second rigid board segment has third and fourth side edges substantially perpendicular to the second connection edge. The third side edge is aligned with the first side edge and the fourth side edge is aligned with the second side edge, when the first and second connection edges are mated. Finally, it includes connection means for securing the first rigid board segment and the second rigid board segment together when the first and second connection edges are mated.

A plurality of hand-holes may be placed parallel to the side edges to permit comfortable lifting and holding of said litter board.

In a preferred embodiment of this invention, the connection means comprise a first rigid partial sleeve for connecting the first side edge and the third side edge and a second rigid partial sleeve for connecting the second side edge and the fourth side edge. In this embodiment the first, second, third and fourth side edges each have a first cross section and a second cross section substantially parallel to those side edges and perpendicular to the litter board. The first such cross section is closer to the respective side edges. Each such first cross section has a greater width than the respective second cross section. In addition, the first sleeve and second sleeve each a substantially c-shaped cross section perpendicular to their length. The c-shaped cross-section is interrupted by an opening along the length of that sleeve. The opening of the c-shape is greater in width than width of the respective second cross section and the opening is also of lesser width than the respective first cross section.

The present invention also comprises a method of manufacturing a litter board. First a closed cell rigid foam core is shaped to the desired shape of the board by cutting the board from a foam sheet and heating the foam board. The foam core is then pulled against a mold to form a concavity on one side. Next the foam core is covered with a composite matrix material, preferably a composite matrix material. Finally the composite matrix material is covered with a smooth coating material. In a preferred embodiment of this method, the foam core is covered with a layer of tear resistant material prior to covering the foam core with the carbon fibrous material.

DETAILED DESCRIPTION OF THE INVENTION

Figure 1:
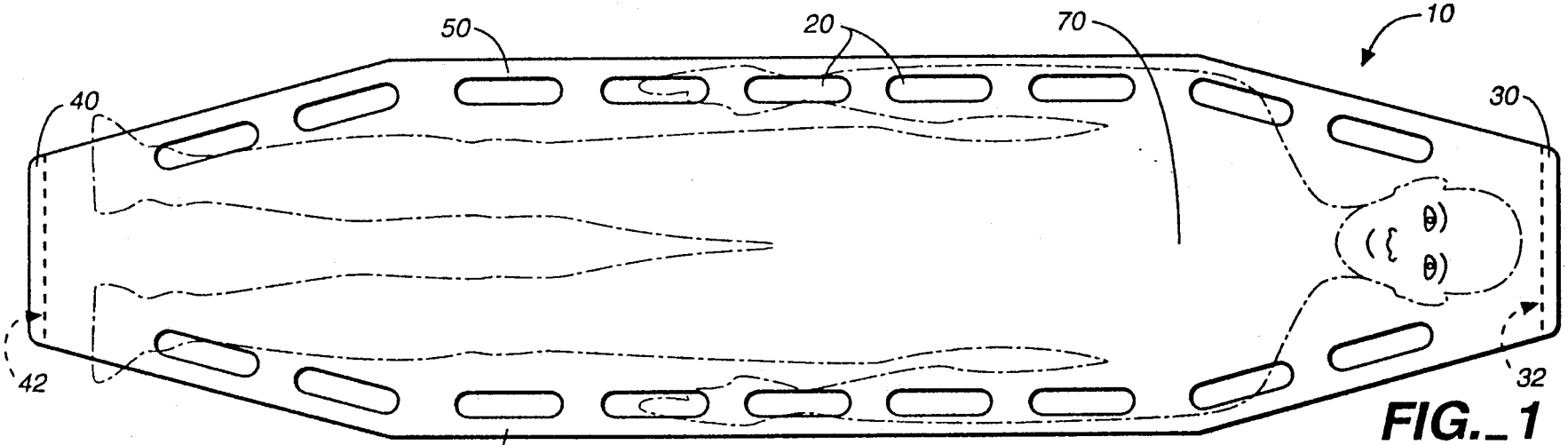
FIG. 1 presents an isometric view of a first preferred embodiment of the present invention.

The present invention relates to devices ("litter boards") for manually transporting injured persons ("patients") to facilities at which they may receive medical treatment. A first preferred embodiment of the litter board of the present invention is illustrated in FIGS. 1–4, with numbering of elements being consistent throughout. FIG. 1 shows an isometric view of the litter board 10. The board is sized to support a patient as shown. Therefore in the preferred implementation of this embodiment litter board 10 is 73 inches in length, 18 inches wide, and 1 inch thick, and weighs 11 lbs.

Litter board 10 also contains a plurality of hand-holes 20 disposed upon either patient right side 50 or patient left side 60 of litter board 10. These hand-holes permit the medical personnel to more easily lift and transport the litter board 10. In the preferred implementation of this embodiment there are nine such hand-holes 20 disposed on each side, hand-holes 20 being 1.25 inches wide and 5 inches long.

Litter board 10 also has a head edge 30 and a foot edge 40. These edges are of shorter length than the distance between the sides 50 and 60 at the center of litter board 10 due to a tapering towards the head and foot ends, as shown in FIG. 1. Each edge has an associated notch 32 and 42, respectively. These notches serve two purposes. First, they allow a separate handle piece to be placed at the ends of the litter board to facilitate carrying by medical personnel, as will be discussed in detail below regarding FIG. 5. Second, these notches assist in immobilizing litter board 10 while in a moving vehicle to prevent sliding during acceleration and deceleration.

Figure 2:
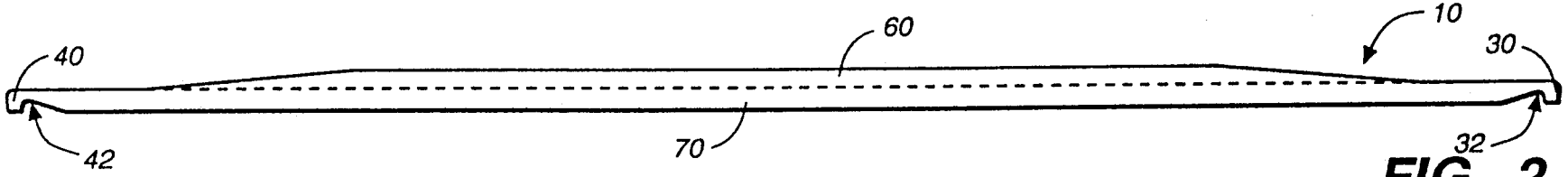
FIG. 2 presents a side view of the litter board 10 of FIG. 1.

FIG. 2 provides a side view of litter board 10 of FIG. 1. This view more clearly illustrates the notches 32, 42. In addition, it shows that the side edged 50 and 60 are inclined vertically ("bowing") relative to the base 70 of litter board 10. This assists in immobilizing the patient during transport of litter board 10. In the preferred embodiment of the present invention this bowing is 2" in displacement.

Figure 3:
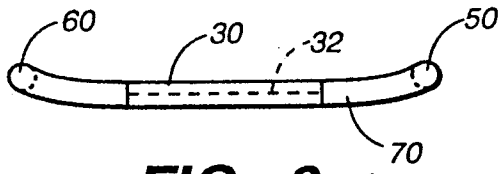
FIG. 3 presents an end view of the litter board 10 of FIG. 1.

FIG. 3 provides an end view of litter board 10 from the head edge 30. It illustrates the two side edges 50 and 60 as well as the hidden line of the notch 32.

Figure 4:
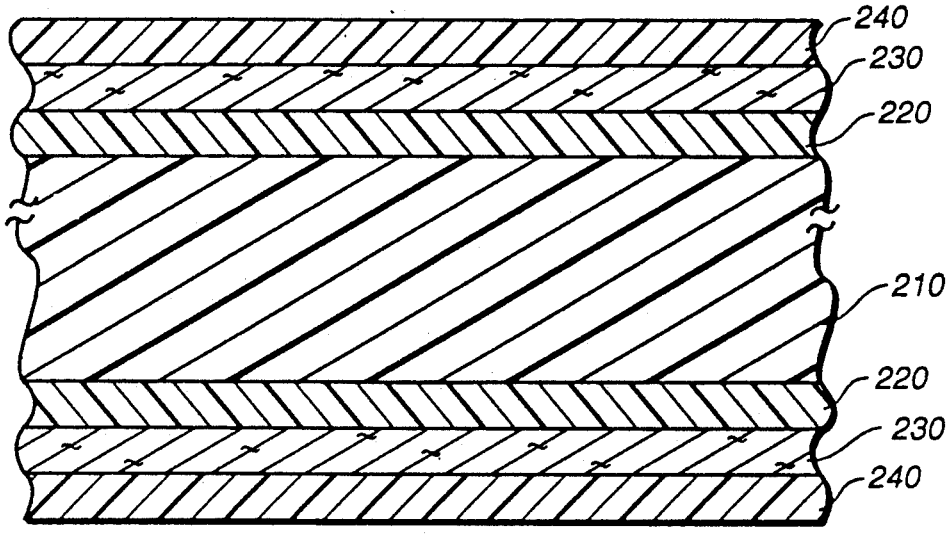
FIG. 4 illustrates a cross-section of a preferred embodiment of a litter board according to the present invention.

An exemplary cross-section of a litter board according to the present invention is shown in FIG. 4. Central to the litter board is a foam sheet 210 of closed cell rigid foam. In the preferred embodiment this layer is manufactured from Klegisil TM, although suitable alternative materials will be obvious to those skilled in the art. Such a material is lightweight, non-absorbent, and is easy to clean. In addition, this material floats. It is preferred that the core be one inch thick.

A second layer, a composite matrix layer 220, is provided. This layer adds tensile strength to the unit. It is preferred that this layer be manufactured from a carbon fiber layer, although glass, ceramic or other composite materials may be used. A third layer, a tear resistant material layer 230, preferably of a fabric, is also provided. In the preferred embodiment of the present invention this layer is manufactured from Kevlar TM, but other alternative materials will be obvious to those skilled in the art. Together carbon fiber layer 220 and tear resistant material layer 230 provide additional support for foam board segment 210, and substantially encapsulate that board segment.

Finally, a smooth coating layer 240 may be provided for improved cleaning of the litter board. In the preferred embodiment this layer is manufactured from fiber glass, although suitable alternatives, such as a "gel coat" covering of a fiber glass layer, will be obvious to those skilled in the art.

While the above layers have been specified in a determined order, it will be obvious to those skilled in the art that the number of layers, order of the layers and the specific materials chosen may be varied while providing a suitable construction. Hence this invention is not to be limited to the specific configuration taught herein.

A litter board according to the present invention may be manufactured as follows. First, a foam core is formed by cutting and shaping the foam core from a closed cell rigid foam sheet. In the preferred embodiment this layer is manufactured from Klegisil TM, as discussed above. The preferred shape of the core is the same as the shape of the board, and is discussed in detail above. This shaping may be accomplished by routing.

The board segment is then heated so as to make the foam soft. The softened board is then pulled against a mold to form a concavity on one side. The pulling is accomplished by suspending the board from nearby head edge 30 and foot edge 40 and suspending a 175 lb weight to the center of litter board 10. This weight is maintained until a bowing of 2 inches is achieved.

The board segment is then covered with a plurality of layers, as discussed above regarding FIG. 4. Specifically, the board segment may be covered with a carbon fibrous material, a tear resistant material and a smooth coating material. As discussed above, in the preferred embodiment the tear resistant material used is Kevlar TM and the smooth coating material is fiber glass. The size and order of these layers is discussed in detail above. A variety of coating methods may be utilized, including blowing on a fiber layer.

Figure 5:
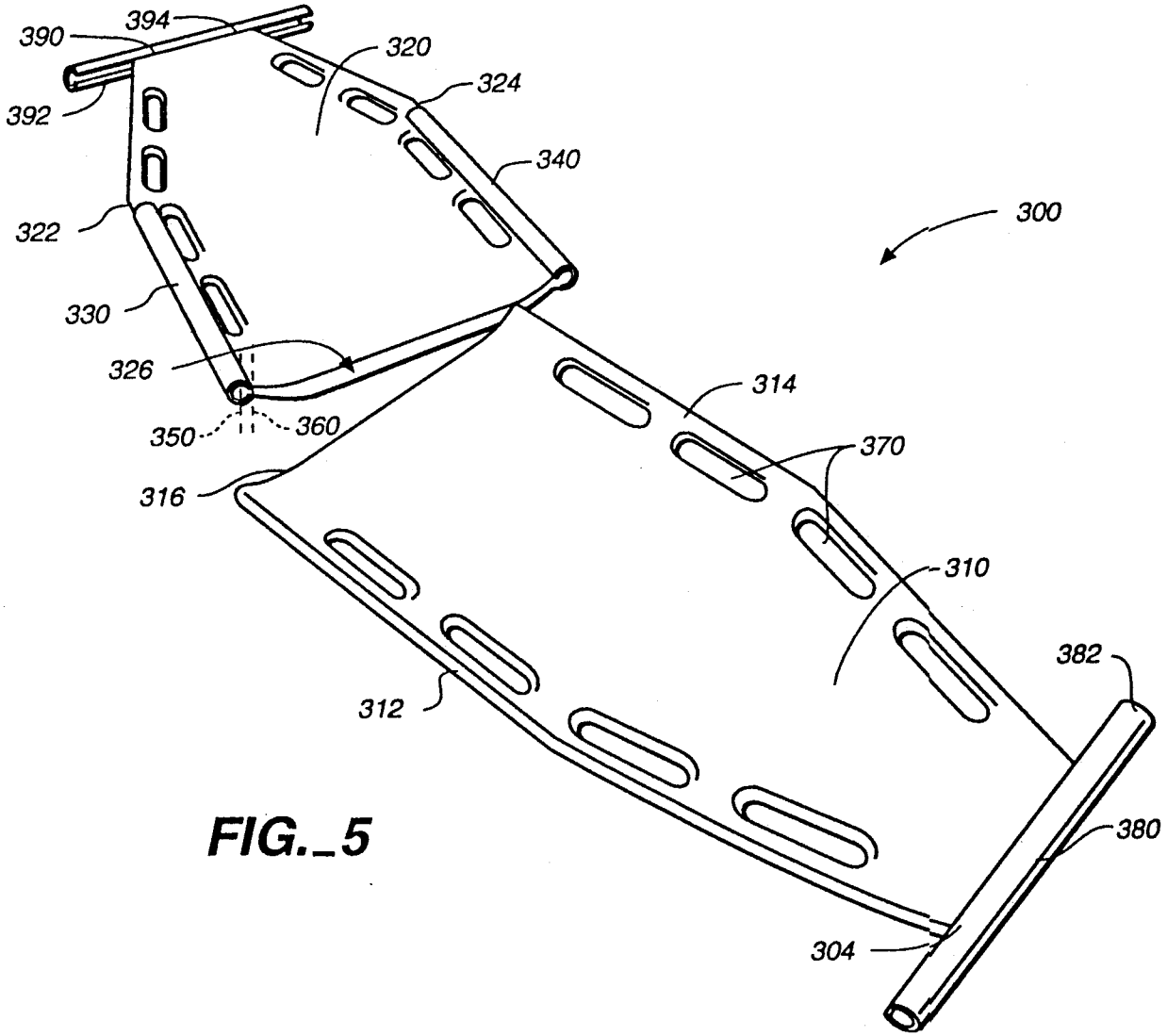
FIG. 5 shows an isometric view of a second embodiment of a litter board according to the present invention in a disassembled state.
Figure 6:
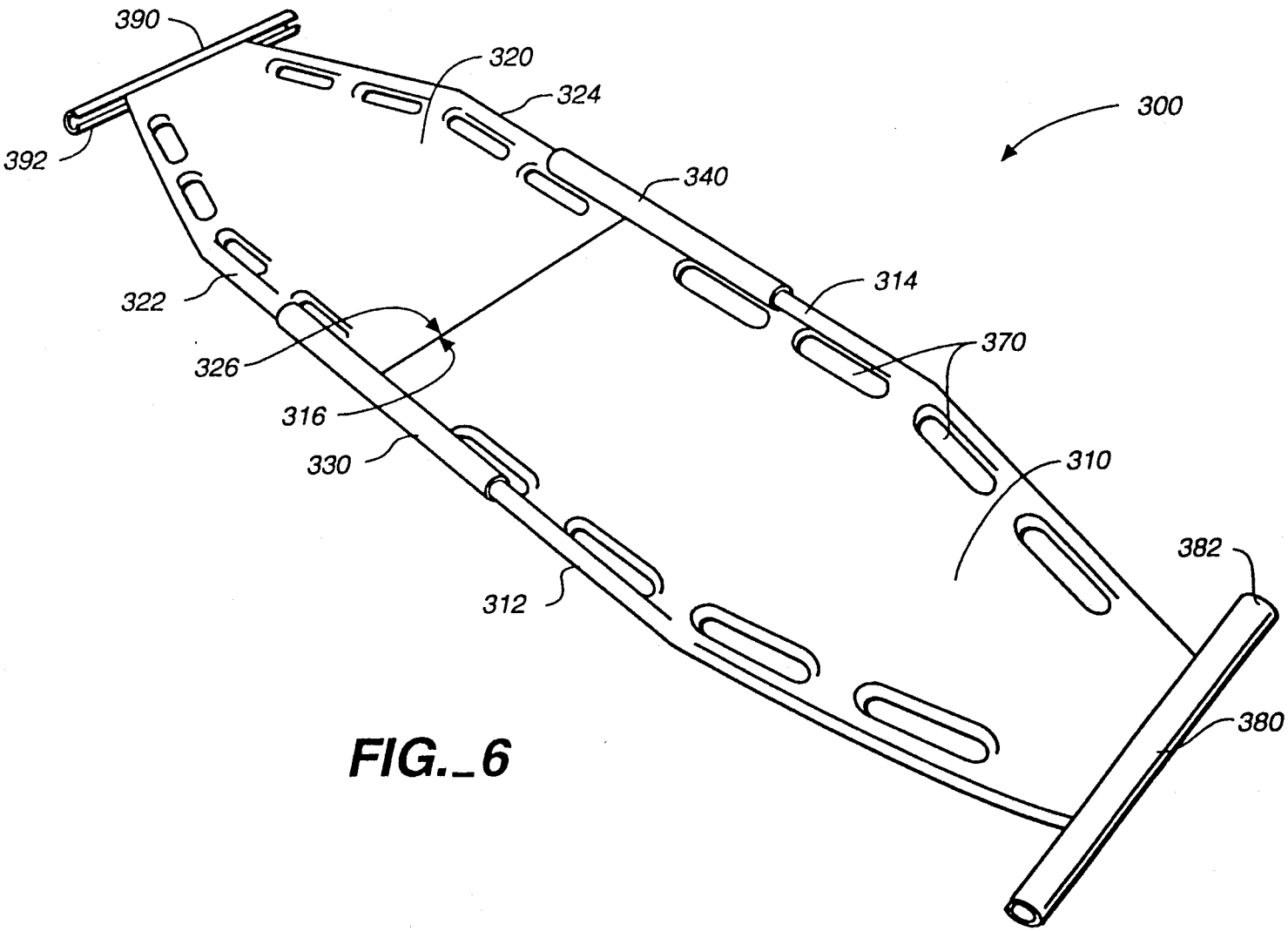
FIG. 6 shows the embodiment of FIG. 5 in an assembled state.
Figure 7:
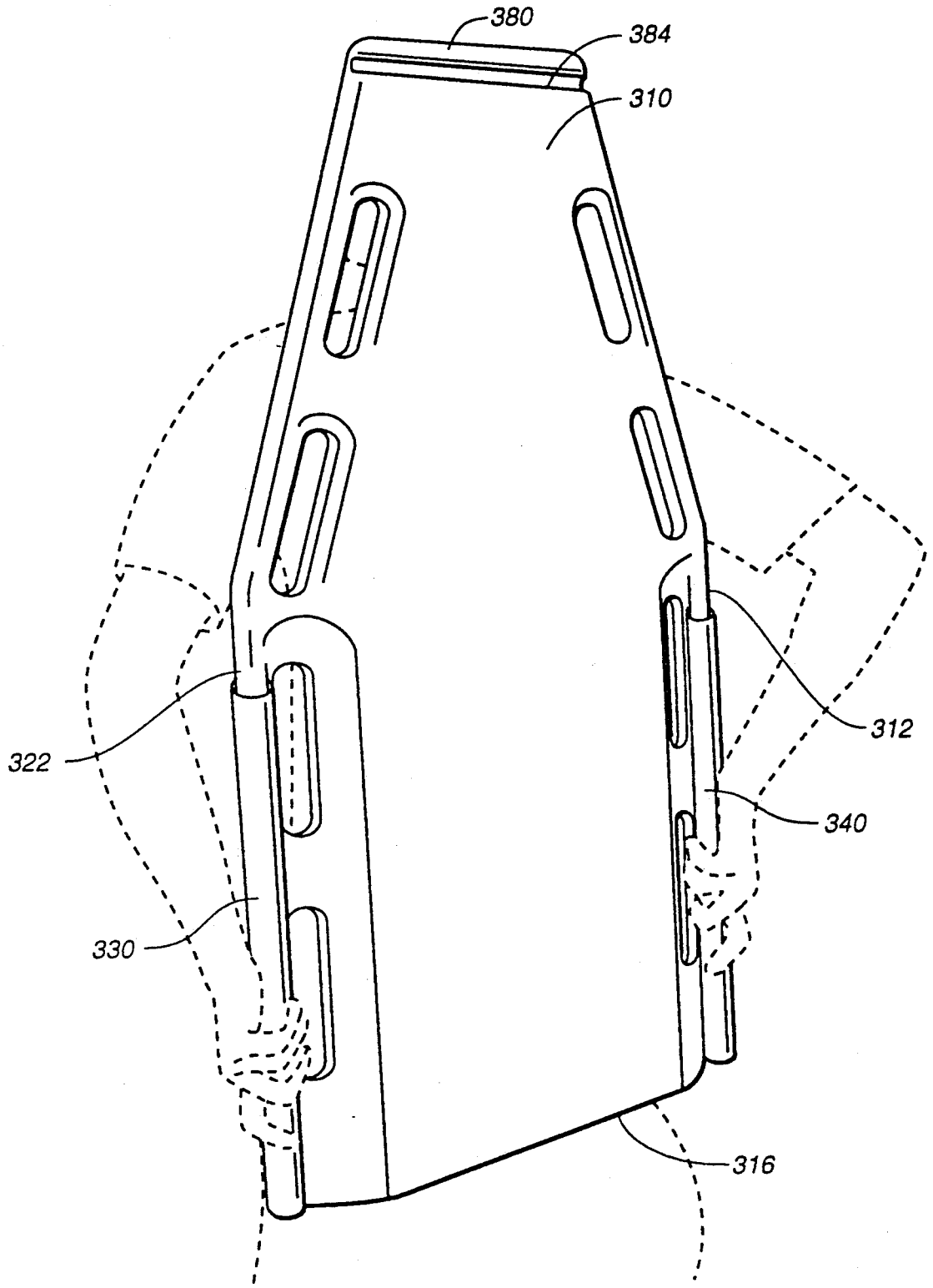
FIG. 7 shows a board segment of FIGS. 5 and 6 carried upon the back of a person.

A second embodiment of a composite litter board is shown in FIGS. 5, 6 and 7, with common number representing corresponding elements. In this embodiment the litter board 300 is divided into two segments 310 and 320, and attached using rigid partial sleeves 330 and 340 to form an assembled unit. This embodiment permits disassembly of the litter board 300 and may be transported by two separate medical personnel, as will be discussed in detail below. It should be noted that the manufacture and sizing of litter board 300 may be identical to that described above.

First rigid board segment 310 has a first connection edge 316 and first side edge 312 and second side edge 314. First side edge 312 and second side edge 314 are substantially perpendicular to first connection edge 316. Second rigid board segment 320 has a second connection edge 326 and a third side edge 322 and fourth side edge 324. Third side edge 322 and fourth side edge 324 are substantially perpendicular to second connection edge 326. Second connection edge 326 is shaped to mate with first connection edge 316. Third side edge 322 is aligned with first side edge 312 and fourth side edge 324 is aligned with second side edge 314, when first connection edge 316 and second connection edge 326 are mated, as shown in FIG. 6.

First rigid board segment 310 and second rigid board segment 320 may be connected to form a complete litter board. Therefore connection means are provided for securing first rigid board segment 310 and second rigid board segment 320 together when first connection edge 316 and second connection edge 326 are mated. The connection means comprise two rigid partial sleeves, first rigid partial sleeve 330 for connecting first side edge 312 and third side edge 322, and a second rigid partial sleeve 340 for connecting second side edge 314 and fourth side edge 324.

The manner in which sleeves 330 and 340 operate is as follows. First side edge 312, second side edge 314, third side edge 322 and fourth side 324 each have a first cross section 350 and a second cross section 360 substantially parallel to that side edge and perpendicular to the respective litter board segment 310, 320. First cross section 350 is closer to the respective side edge. First cross section 350 has a greater width than second cross section 360. First rigid partial sleeve 330 and second rigid partial sleeve 340 are essentially cylindrical in the preferred implementation of this embodiment. Hence each has a length and a substantially c-shaped cross section perpendicular to that length. The c-shaped cross-section is interrupted by an opening along the length of said sleeve, corresponding to second cross section 360. Thus the opening is greater in width than the width of second cross section 360 and yet of lesser width than first cross section 350. This configuration prevents the sleeve from slipping from the respective side edge.

The method of assembly of this embodiment may be seen from FIGS. 5 and 6. First rigid partial sleeve 330 and second rigid partial sleeve 340 are disposed on one or both of the rigid board segments 310 or 320, second rigid board segment 320 being chosen in FIG. 5. First connection edge 316 and second connection edge 326 are placed in mating position. First rigid partial sleeve 330 and second rigid partial sleeve 340 are then slid along their respective side edges such that first rigid partial sleeve 330 is attached to both first side edge 312 and third side edge 322, and second rigid partial sleeve 340 is attached to both second side edge 314 and fourth side edge 324, as shown in FIG. 6.

In addition to the elements shown above, composite litter board 300 has a plurality of hand-holes 370 disposed parallel to the four side edges 312, 314, 322 and 324. These hand-holes correspond to the hand-holes 20 of FIG. 1, and likewise permit the medical personnel to more easily lift and transport the litter board 300.

In addition, litter board 300 has a head edge 380 and a foot edge 390, also like their corresponding elements from FIG. 1, head edge 30 and foot edge 40. Likewise they too have notches 384 and 394, similar to those described above. This may be clearly seen in FIG. 7, discussed below. These notches are such that a head handle 392 and a foot handle 382 may be slid over the respective end edge 380, 390 to assist in handling the litter board 300.

It will be obvious to those skilled in the art that the handles 382 and 384 may be constructed identically to rigid partial sleeves 330 and 340. Hence both first rigid board segment 310 and second rigid board segment 320 may carry two sleeves/handles, as shown in FIG. 5 for second rigid board segment 320. Two of these pieces would serve as sleeves, while the remaining two would serve as handles. FIG. 7 illustrates one such segment, first rigid board segment 310, being carried on the back of one of the two medical personnel. Each such segment may be comfortably carried in such a position, and is sufficiently lightweight (under six lbs.) for sustained transport in such a position. Therefore in a preferred embodiment of the present invention, each rigid board segment may be attached to the frame of a backpack for simple transportation. Such a configuration will additionally provide flotation benefits, as well as shield the wearer from many projectiles impacting from behind the wearer. These advantages are significant, as environments which caused the severe injuries to the patient often are hostile to the medical personnel as well.

There has been described herein an improved litter board and method of manufacturing the same. Various modifications to the present invention will become apparent to those skilled in the art from the foregoing description and accompanying drawings. Accordingly, the present invention is to be limited solely by the following claims.

What is claimed is:

1. A composite litter board comprising:

a first rigid board segment having a first connection edge and first and second side edges substantially perpendicular to said first connection edge;

a second rigid board segment separable from said first rigid board segment and having a second connection edge shaped to mate with said first connection edge, said second rigid board segment having third and fourth side edges substantially perpendicular to said second connection edge, said third side edge being aligned with said first side edge and said fourth side edge being aligned with said second side edge, when said first and second connection edges are mated; and connection means for securing said first rigid board segment and said second rigid board segment together when said first and second connection edges are mated, said connection means comprising a first rigid partial sleeve for connecting said first side edge and said third side edge and a second rigid partial sleeve for connecting said second side edge and said fourth side edge;

said first, second, third and fourth side edges each having a first cross section and a second cross section substantially parallel to said side edges and perpendicular to said litter board, said first cross section being closer to said side edges, said first cross section having a greater width than said second cross section, said first rigid partial sleeve and said second rigid partial sleeve each having a length and a substantially c-shaped cross section perpendicular to their length, said c-shaped section having an opening greater in width than the width of said second cross section of said litter board and said opening being of lesser width than said first cross section of said litter board.

2. The composite litter board of claim 1 wherein said composite litter board has a plurality of hand-holes disposed parallel to said first, second, third and fourth side edges, said hand-holes being such as to permit comfortable lifting and holding of said litter board.

* * * * *